United States Patent [19]

Baker

[11] 3,994,463

[45] Nov. 30, 1976

[54] PORTABLE CURTAIN ROD SUPPORT

[75] Inventor: David T. Baker, Napa, Calif.

[73] Assignee: The Raymond Lee Organization, Inc., New York, N.Y. ; a part interest

[22] Filed: Sept. 15, 1975

[21] Appl. No.: 613,119

[52] U.S. Cl. ..... 248/265; 248/287

[51] Int. Cl.[2] ..... A47H 1/10

[58] Field of Search ..... 248/201, 261–265, 248/354 R, 354 S, 251–260, 266–273, 276, 287

[56] References Cited

UNITED STATES PATENTS

| | | | |
|---|---|---|---|
| 340,968 | 4/1886 | Levering | 248/354 S X |
| 644,758 | 3/1900 | Beck | 248/265 |
| 758,158 | 4/1904 | Verkler | 248/259 |
| 939,808 | 11/1909 | Cook | 248/252 |
| 1,405,257 | 1/1922 | Bauman | 248/262 |
| 1,791,006 | 2/1931 | Shorr | 248/263 |
| 1,819,173 | 8/1931 | Hunley et al. | 248/354 S X |
| 2,694,946 | 11/1954 | Vandal | 248/354 S X |
| 3,111,723 | 11/1963 | Bates | 248/354 S X |
| 3,224,429 | 12/1965 | Quittner | 248/354 R X |
| 3,434,685 | 3/1969 | Gorgone | 248/263 |
| 3,730,469 | 5/1973 | Shields | 248/265 |

FOREIGN PATENTS OR APPLICATIONS

| | | | |
|---|---|---|---|
| 354,427 | 7/1905 | France | 248/265 |
| 186,177 | 9/1922 | United Kingdom | 248/265 |

*Primary Examiner*—Lawrence J. Staab
*Attorney, Agent, or Firm*—Howard I. Podell

[57] ABSTRACT

An assembly for the support of curtains or drapes about a window which eliminates the necessity of nails, screws or other fasteners in the framework of the window. The assembly consists of two poles fitted with threaded ends for adjusting to length which are set vertically in the frame of a window and two brackets which may be each clamped along the length of a pole with each bracket fitted with a hanger for mounting of a conventional curtain or drape rod, in the installed position.

2 Claims, 5 Drawing Figures

PORTABLE CURTAIN ROD SUPPORT

SUMMARY OF THE INVENTION:

My invention is an assembly for the support of curtains or drapes about a window which eliminates the necessity of nails, screws or other fasteners in the framework of the window. The assembly consists of two poles fitted with threaded ends for adjusting to length which are set vertically in the frame of a window and two brackets which may be each clamped along the length of a pole with each bracket fitted with a hanger for mounting of a conventional curtain or drape rod, in the installed position.

The support unit may be readily removed from a window frame for cleaning purposes, with the window frame unmarred, and the unit permits vertical adjustment of the height of supported curtains in the installed position.

BRIEF DESCRIPTION OF THE DRAWINGS:

The objects and features of the invention may be understood with reference to the following detailed description of an illustrative embodiment of the invention, taken together with the accompanying drawings in which.

Figure 1:
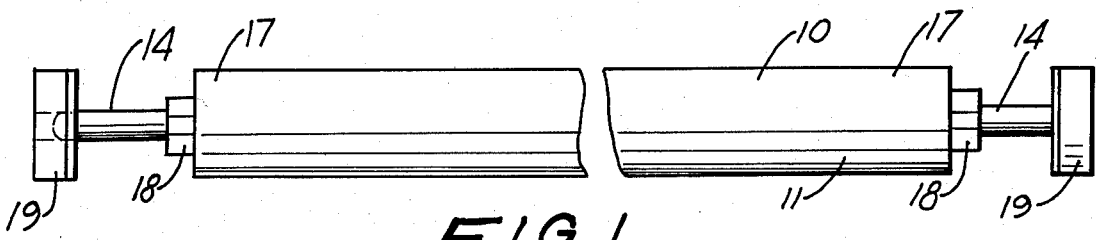
FIG. 1 is an elevation view of a vertical support pole.
Figure 3:
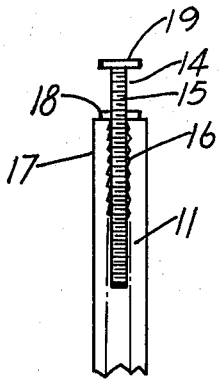
FIG. 3 is a fragmentary view of the end of a vertical support pole.
Figure 4:
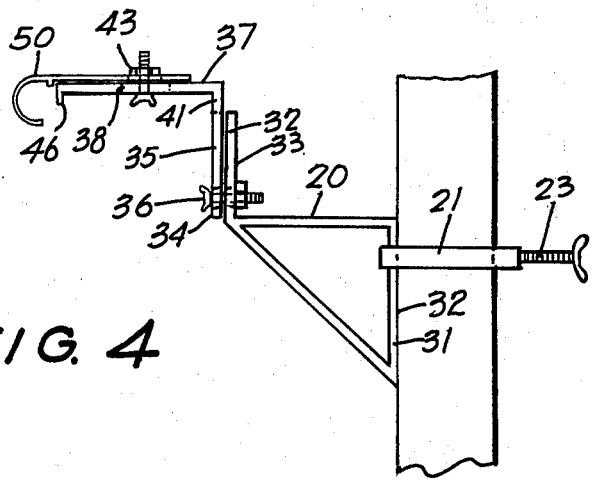
FIG. 4 is a side view of the bracket and pole.

DESCRIPTION OF THE PREFERRED EMBODIMENT:

Turning now descriptively to the drawings, in which similar reference characters denote similar elements throughout the several views, FIG. 4 shows the curtain rod bracket 20 fastened by attached clamp 21 to a cylindrical vertical support pole 10. As shown in FIGS. 1 and 3, vertical support pole 10 comprises a cylindrical rod 11, fitted at each end to a threaded adjustment leg 14. Leg 14 consists of a male screw 15 which engages a mating female thread 16 axially formed in each rod end 17. A nut 18 locks thread 16 in place and a rubber disc 19 is fastened to the external end of leg 14. By rotation of legs 14, a pole may be placed in vertical orientation inside a window frame with the two leg discs 19 bearing against the top and bottom ledges inside the frame to hold the pole 10 fixed in place.

Figure 2:
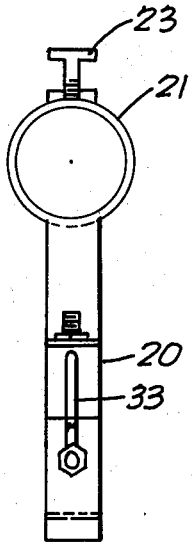
FIG. 2 is a plan view of a support bracket.

As shown in FIGS. 2–4, a bracket 20 is fitted with a clamp 21 for fastening about a pole 11, with clamp 21 fitted with a thumbscrew 23 for tightening clamp 21 and attached bracket 20 to the pole 11 at a desired height along the pole.

Bracket 20 is in the shape of a reinforced angle section 31, mounted on a rear side 32 to clamp 21 and fitted with a vertical arm section 32. A slot 33 in vertical arm section 32 permits vertical leg section 41 of angle member 34 fitted with a similar slot 35 to be adjustably joined to arm section 32 of angle 31 by a thumbscrew 36 for vertical adjustment of angle member 34. A slot 38 in the horizontal leg section 37 of angle member 34 permits a thumbscrew 43 to fasten a curtain hanger clip 50 to horizontal leg section 37 so as to permit horizontal adjustment in the installed position of clip 50 to tighten clip 50 about a curtain rod (not shown) in conventional manner against flange 46 at the end of horizontal leg section 37.

Figure 5:
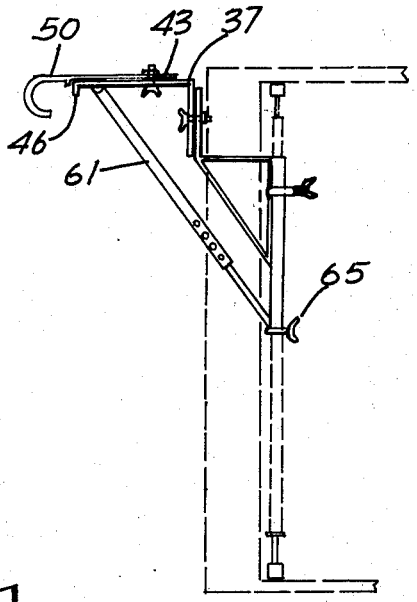
FIG. 5 is a side view of the installation of an alternate embodiment of the invention.

As shown in FIG. 5, a telescopic support member 61 of adjustable length may be fastened to both horizontal leg section 37 of angle member 34 and to a clamp 65 fitted about pole 11 for additional support of heavy draped on a curtain rod supported by bracket 20.

In use, two or more poles 11 are vertically mounted inside a window frame and a bracket 20 clamped at the desired height to each pole 11. A curtain rod is then fastened to the clips 50 of each bracket 20.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A curtain rod support assembly consisting of two support poles and a bracket mounted on each pole, with an end of each pole fitted with adjustable screw thread means to vary the length of each pole, so that both poles may be fixed in spaced vertical orientation inside a window frame by lengthening the thread means to bear against the top and bottom frame members of the window frame in which each bracket is mounted on a pole by means of a detachable clamp means which permits mounting the bracket, in a desired position, along the length of a pole, said bracket fitted with brace means oriented to extend in a radial direction from the pole in which it is clamped, said bracket fitted with clip means to detachably fasten about a curtain rod oriented perpendicular to the axis of the support pole to which the bracket is mounted by said clamp means, said clip means fastened to said bracket by an angle member formed of a first leg section and a second leg section, oriented generally perpendicular to each other, said first leg section slidably fastened to the said clip means and said second leg section slidably fastened to the bracket such that the clip means may be adjusted independently along two perpendicular axes with respect to the bracket.

2. The combination as recited in claim 1 in which the axes of said first and second leg sections are oriented in a common plane with the axes of the bracket and the axis of a support pole to which the bracket is mounted, to permit extending the clip means independently along the axis of the support pole and perpendicular to the axis of the support pole so that the said clip means may be located at a horizontal distance from a window frame in which the pole is mounted and at a vertical height independent of the height of the top member of a window frame against which an end of the support rod bears in the assembled condition.

* * * * *